US007988260B2

(12) United States Patent
Kudo et al.

(10) Patent No.: US 7,988,260 B2
(45) Date of Patent: Aug. 2, 2011

(54) RECORDING ELEMENT SUBSTRATE AND RECORDING HEAD INCLUDING RECORDING ELEMENT SUBSTRATE

(75) Inventors: Tomoko Kudo, Kawasaki (JP); Tatsuo Furukawa, Zama (JP); Nobuyuki Hirayama, Fujisawa (JP); Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/621,448

(22) Filed: Nov. 18, 2009

(65) Prior Publication Data

US 2010/0123971 A1 May 20, 2010

(30) Foreign Application Priority Data

Nov. 20, 2008 (JP) ..... 2008-296697

(51) Int. Cl.
*B41J 2/05* (2006.01)

(52) U.S. Cl. ..... 347/61; 347/60; 347/59; 347/67; 347/40; 347/56

(58) Field of Classification Search ..... 347/5, 6, 347/17–19, 14, 40, 56, 59–61, 67
See application file for complete search history.

(56) References Cited

U.S. PATENT DOCUMENTS

| | | | | |
|---|---|---|---|---|
| 4,429,321 | A * | 1/1984 | Matsumoto | 347/59 |
| 4,980,702 | A * | 12/1990 | Kneezel et al. | 347/17 |
| 5,175,565 | A * | 12/1992 | Ishinaga et al. | 347/67 |
| 5,424,767 | A * | 6/1995 | Alavizadeh et al. | 347/17 |
| 6,243,111 | B1 * | 6/2001 | Imanaka et al. | 347/13 |
| 6,315,396 | B1 * | 11/2001 | Ozaki et al. | 347/60 |
| 6,357,863 | B1 * | 3/2002 | Anderson et al. | 347/58 |
| 6,742,874 | B2 * | 6/2004 | Hirayama et al. | 347/57 |
| 2002/0041307 | A1 | 4/2002 | Yabe | |
| 2003/0081033 | A1 * | 5/2003 | Giere et al. | 347/17 |
| 2005/0190232 | A1 * | 9/2005 | Lee et al. | 347/45 |
| 2006/0017774 | A1 * | 1/2006 | Beak | 347/44 |
| 2006/0139383 | A1 * | 6/2006 | Hayasaki | 347/5 |

FOREIGN PATENT DOCUMENTS

JP 2002-079671 3/2002

* cited by examiner

*Primary Examiner* — Matthew Luu
*Assistant Examiner* — Henok Legesse
(74) *Attorney, Agent, or Firm* — Canon USA Inc IP Division

(57) ABSTRACT

A recording element substrate includes a recording element array including a plurality of recording elements, a drive circuit configured to drive the recording elements, and a heater located to surround the recording element array as viewed in a direction perpendicular to a surface of the recording element substrate and located above or below a capacitive element or a resistive element included in the drive circuit as viewed on a cross section of the recording element substrate.

6 Claims, 13 Drawing Sheets

RECORDING ELEMENT SUBSTRATE AND RECORDING HEAD INCLUDING RECORDING ELEMENT SUBSTRATE

BACKGROUND OF THE INVENTION

1. Field of the Invention

The present invention relates to a recording element substrate and a recording head including the recording element substrate.

2. Description of the Related Art

FIG. 8 is a diagram illustrating the structure of a recording element substrate discussed in Japanese Patent Application Laid-Open No. 2002-79671. A substrate 300 includes a heater and a drive circuit that are integrally formed by a semiconductor process. A heater array 302A including a plurality of heaters is arranged along an ink supply port 301. A sub-heater 3011 heats the substrate 300 and a temperature detection unit 304 detects the temperature of the substrate 300. Power or signals are input from the outside of the substrate 300 to terminals 305. A drive circuit 303 drives the heaters.

As described above, the drive circuit 303 includes a metal-oxide semiconductor (MOS) transistor whose operation characteristics are changed by heat. Therefore, when the sub-heater 3011 is arranged close to the MOS transistor, the operation of the MOS transistor is likely to be affected by heat generated from the sub-heater 3011. FIG. 12 is a graph illustrating the relationship between a variation in voltage (horizontal axis) between the gate and the source of the MOS transistor and a variation in drain current (vertical axis). When the temperature is changed, voltage-current characteristics are changed.

The operation of a logic circuit is also affected by the temperature. For example, a variation in the speed of a circuit was simulated. As a result of the simulation, one period was about 65 ns (nanosecond) at a temperature of 25° C. and one period was about 90 ns at a temperature of 100° C. The period at a temperature of 100° C. was 1.5 times longer than that at a temperature of 25° C. Thus, when the response speed of a logic circuit is decreased by heat, an error is likely to occur in the operation of the logic circuit.

SUMMARY OF THE INVENTION

The present invention is directed to a recording element substrate including a heater capable of preventing the influence of heat generated from a sub-heater on a circuit of the recording element substrate and controlling the temperature of the recording element substrate.

According to an aspect of the present invention, a recording element substrate includes a recording element array including a plurality of recording elements, a drive circuit configured to drive the recording elements, and a heater located to surround the recording element array as viewed in a direction perpendicular to a surface of the recording element substrate and located above or below a capacitive element or a resistive element included in the drive circuit as viewed on a cross section of the recording element substrate.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
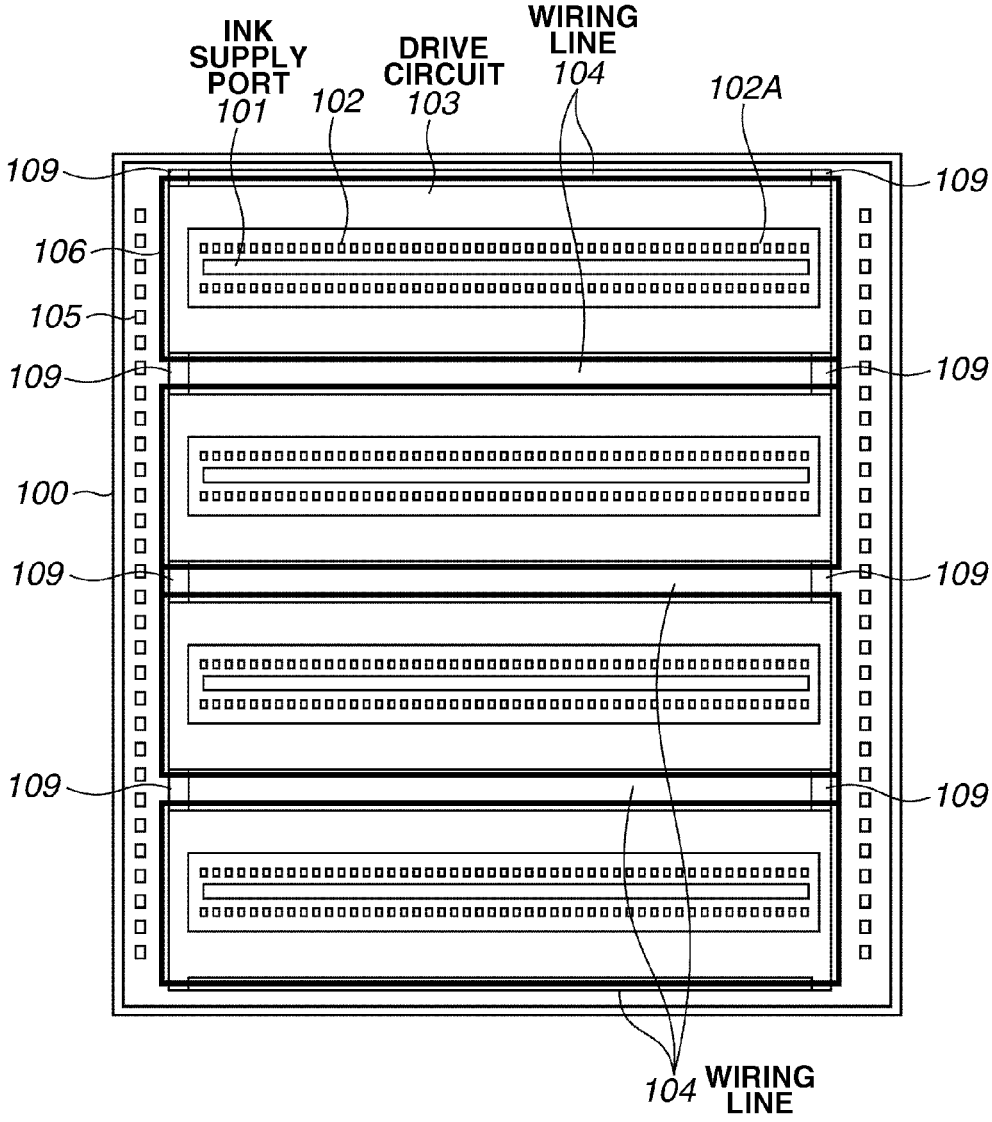
FIG. 1 is a diagram illustrating the arrangement of circuits of a recording element substrate according to a first exemplary embodiment of the invention.
Figure 13:
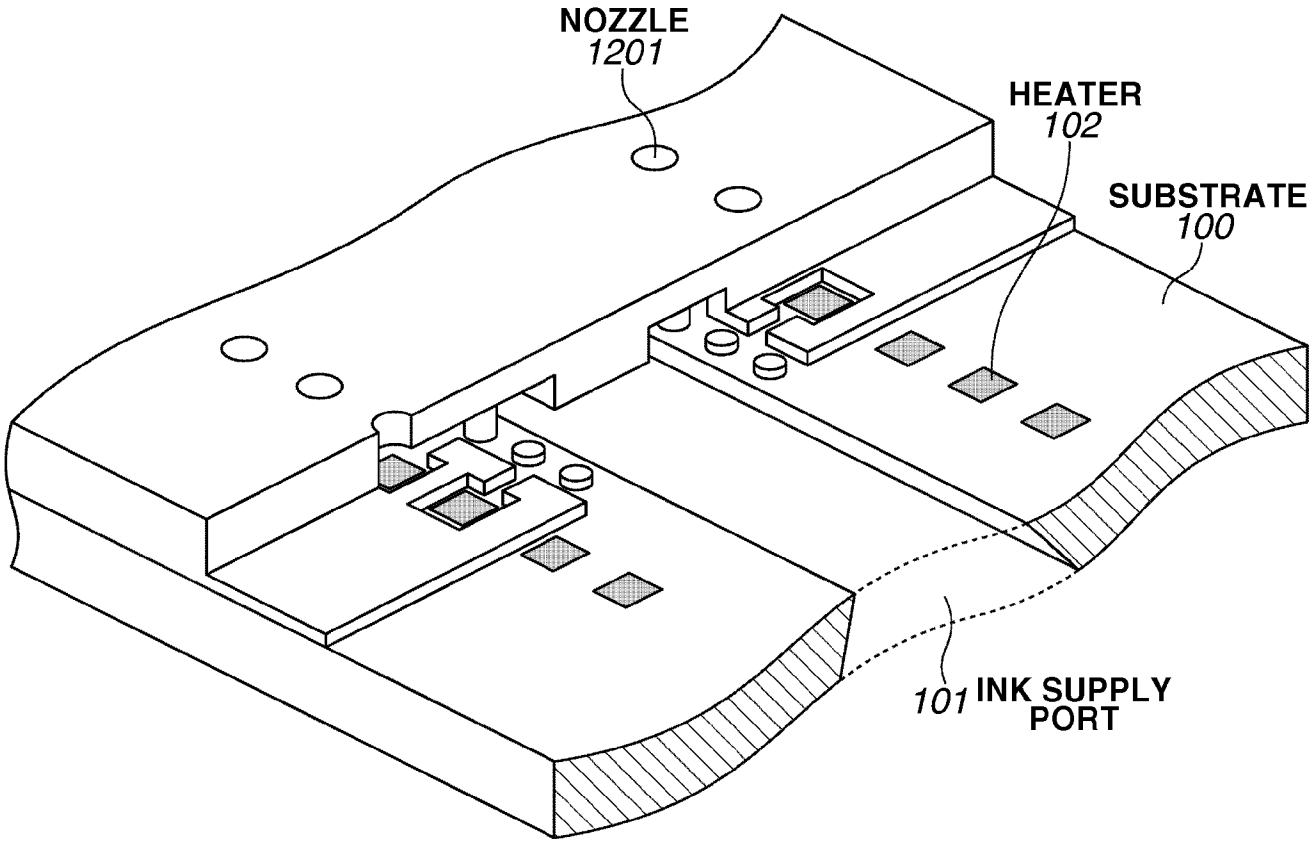
FIG. 13 is a diagram illustrating a portion of a recording head according to the first and second exemplary embodiments.

FIG. 1 is a layout diagram illustrating the surface of a recording element substrate 100 according to a first exemplary embodiment of the invention as viewed from the vertical direction (upper or lower side). Heaters 102 constitute a heater array 102A arranged as illustrated in FIG. 1. A drive circuit 103 includes a transistor or a logic circuit that drives the heaters 102. The logic circuit includes, for example, a shift register and a decoder. A wiring area 104 includes a power line for supplying power and a signal line for supplying a control signal. An external signal or power is input through terminals 105. The wiring area 104 includes a signal line for supplying the signal from the terminal 105 to the drive circuit 103. A capacitive element 109 is connected to, for example, the signal line or the power line that connects the terminal 105 and the drive circuit 103 to prevent the influence of noise on the signal. FIG. 13 is a diagram illustrating a portion of a recording head according to the first exemplary embodiment. Ink is supplied from an ink supply port 101 and is then discharged from a nozzle 1201 by heat generated by the heater 102.

A heater (sub-heater) 106 is a heating unit that heats the substrate 100 to control the temperature of the substrate 100. The heater (sub-heater) 106 is arranged to surround the ink supply port 101 on the surface of the substrate in a plan view of FIG. 1. In addition, the heater 106 is provided above the capacitive element 109. This is because the capacitive element (capacitor) 109 is less affected by heat than a MOS transistor.

Figure 2:
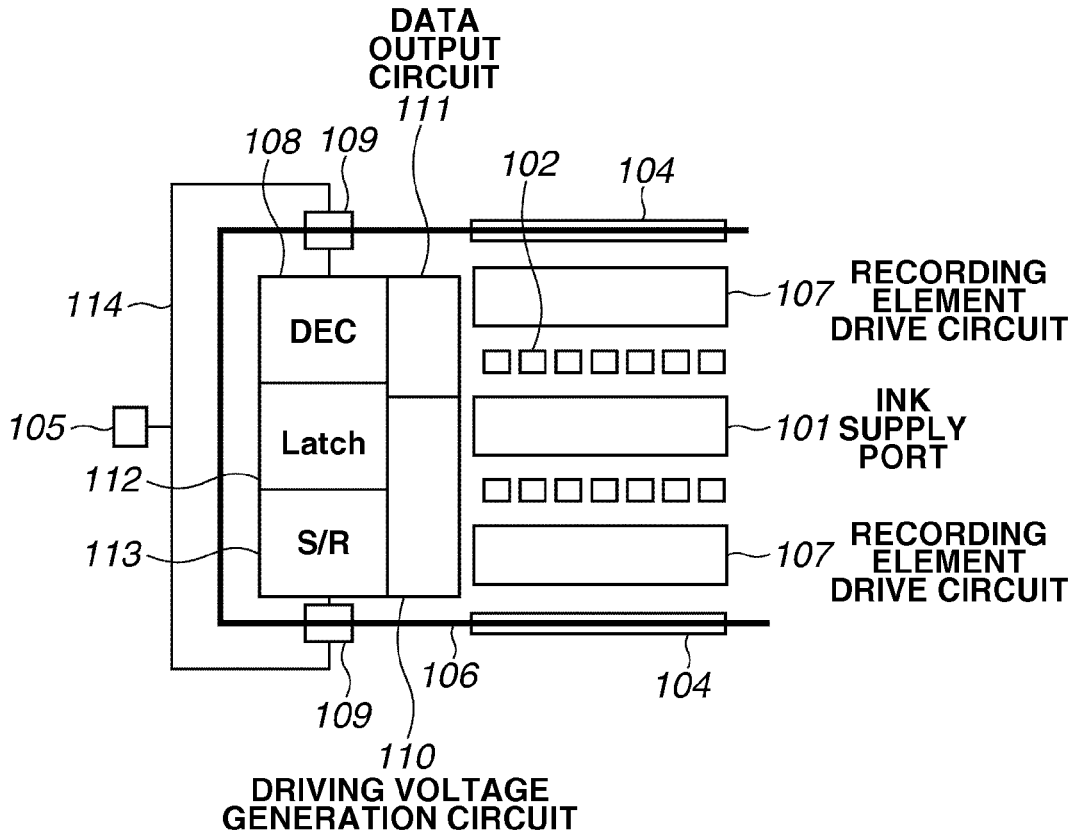
FIG. 2 is an enlarged view illustrating a portion of the circuit illustrated in FIG. 1.

FIG. 2 is an enlarged view illustrating a portion of the drive circuit 103 illustrated in FIG. 1. A description of reference numerals 101 to 107 which have been described with reference to FIG. 1 will not be repeated. For simplicity of description, a description of other signal lines will not be given. The drive circuit 103 illustrated in FIG. 1 includes logic circuits, such as a decoder 108, a driving voltage generation circuit 110, a data output circuit 111, a latch circuit 112, and a shift register 113. The data output circuit 111 checks data signals input from the outside to the shift register 113. A logic voltage VDD is input to the terminal 105 and is then supplied to the decoder 108 through a power line 114. The capacitive element 109 is connected to the power line 114. The power line 114 for supplying the logic voltage VDD is connected to logic circuits, such as the latch circuit 112 and the shift register 113.

Figure 6A:
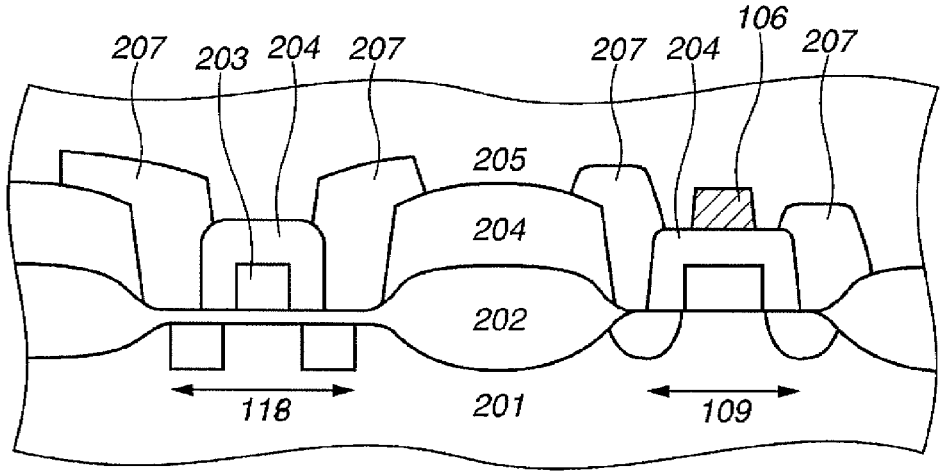
FIGS. 6A and 6B are cross-sectional views illustrating the recording element substrate according to an exemplary embodiment of the invention.

FIG. 6A is a cross-sectional view illustrating the recording element substrate 100. The capacitive element 109 is arranged below the heater (sub-heater) 106. The recording element substrate 100 includes a silicon substrate 201, an oxide film 202, a polysilicon film 203, a boron-doped phospho-silicate glass (BPSG) (an insulating film) 204, an insulating film 205, and an aluminum wiring line 207. Since the MOS transistor 118 is located away from the sub-heater 106, the influence of heat generated from the heater (sub-heater) 106 on the MOS transistor can be reduced.

Figure 10:
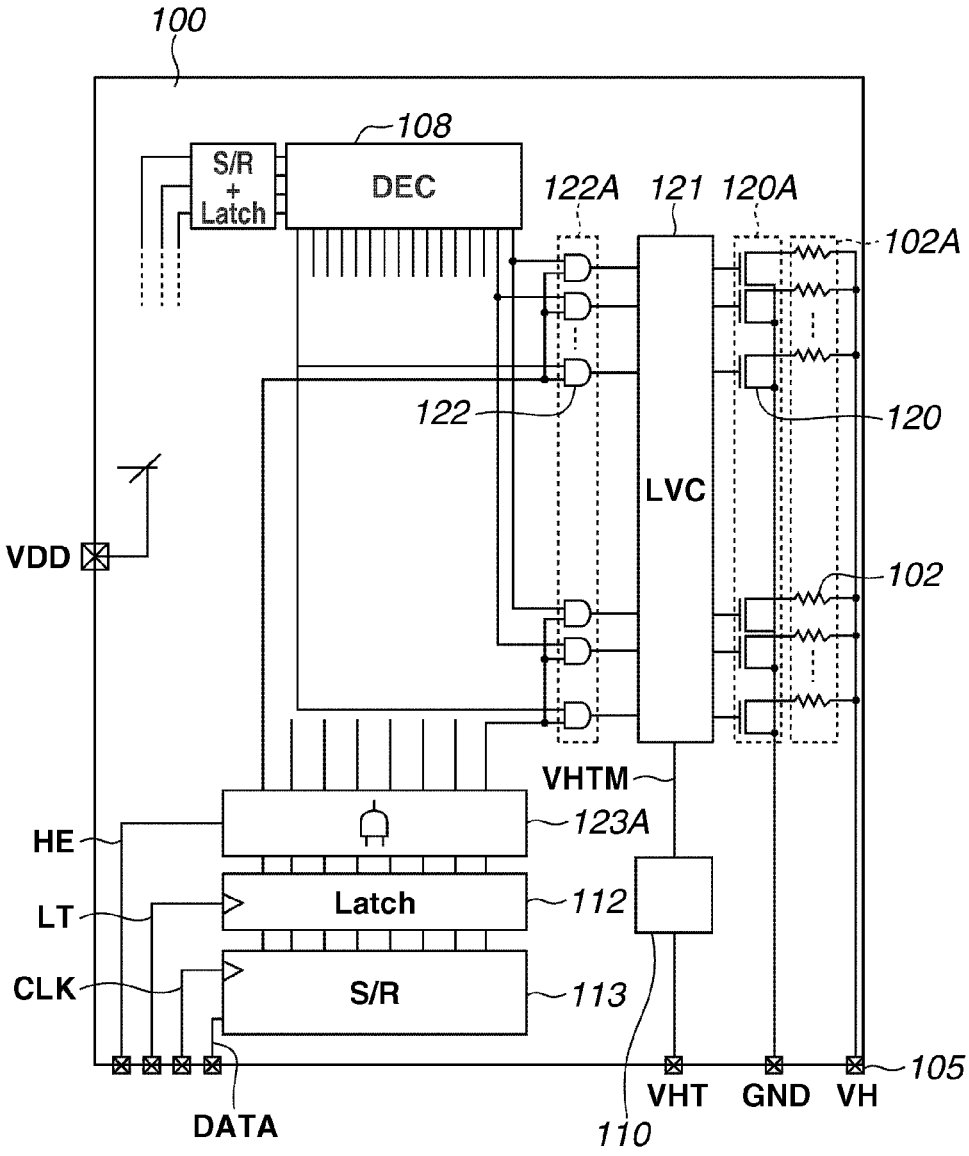
FIG. 10 is a block diagram illustrating the recording element substrate according to the first exemplary embodiment.

FIG. 10 is a functional block diagram illustrating the recording element substrate 100. For simplicity of illustration, some signal lines or some circuit blocks are not illustrated. The recording element substrate 100 includes the terminals 105, and a voltage VH (24 V), a voltage VHT (24 V), a voltage VDD (5 V), a signal DATA, a signal CLK, a signal LT, and a signal HE are input to the terminals 105. The above-mentioned logic circuit includes the decoder 108, the latch circuit 112, the shift register 113, a level converter (LVC) 121, and AND circuits 122A and 123A.

For example, the heater array 102A, which includes 128 heaters 102, performs a time-division driving operation in which 16 heaters are driven at the same time, and 128 heaters are driven for 8 driving timings. Therefore, the shift register 113 stores 16-bit data. The latch circuit 112 latches the data output from the shift register 113.

The driving voltage generation circuit 110 receives the voltage VHT (24 V), generates a voltage VHTM (14 V), and outputs the generated voltage VHTM. The AND circuit 122A is provided to correspond to the heater 102.

Figure 11:
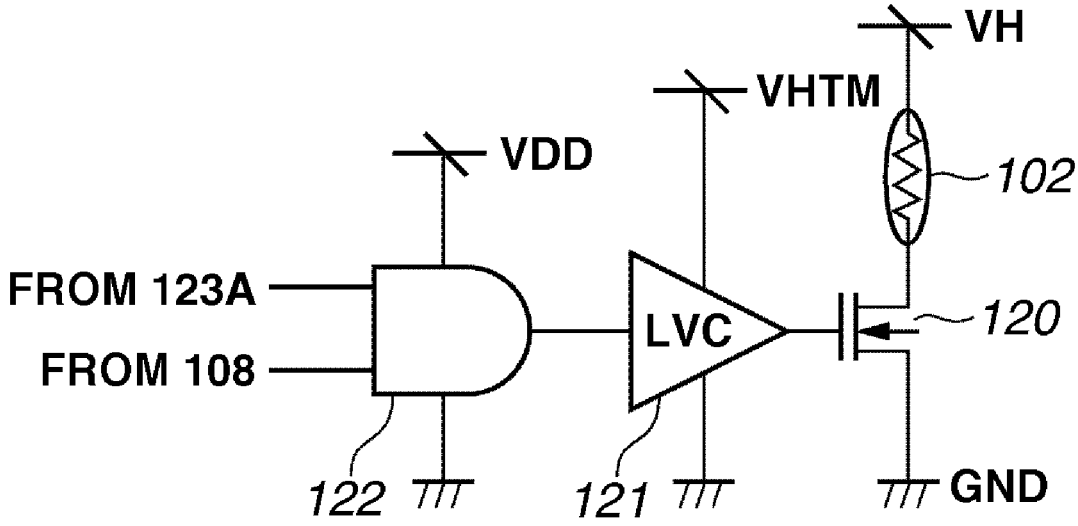
FIG. 11 is a diagram illustrating the structure of a drive circuit for one heater.
Figure 12:
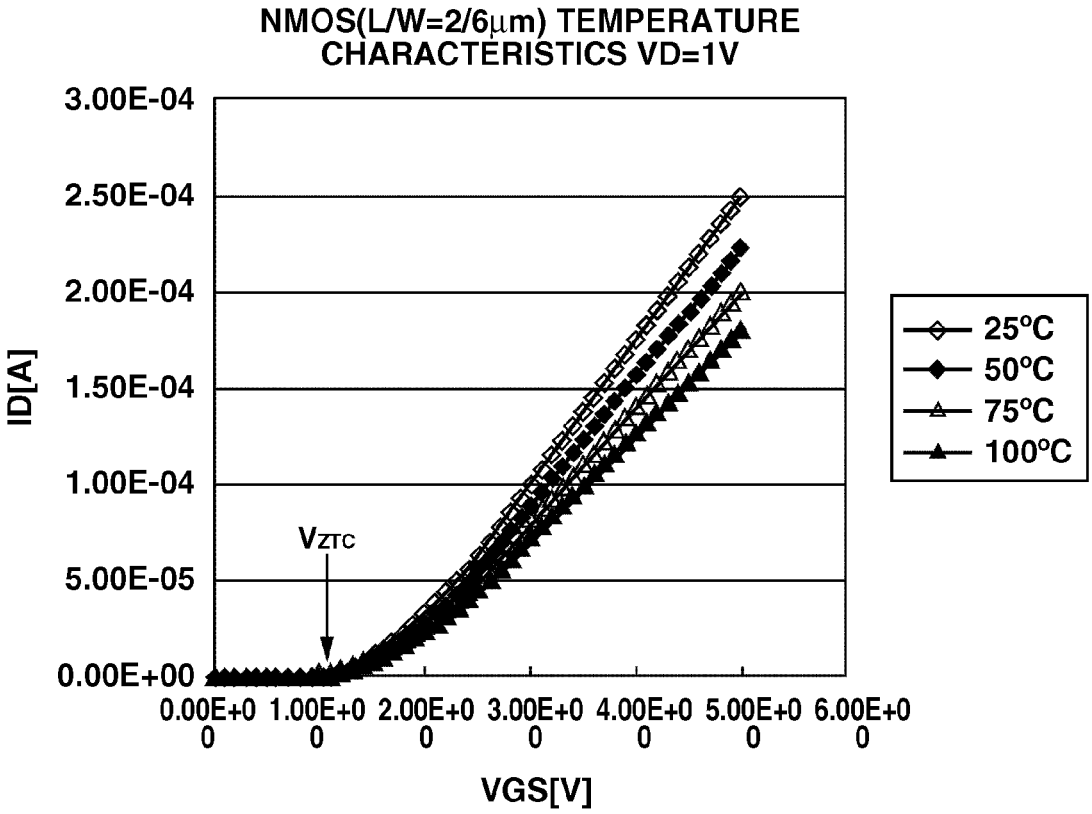
FIG. 12 is a diagram illustrating the temperature characteristics of a MOS transistor.

FIG. 11 is a diagram illustrating a portion of the drive circuit 103. For simplicity of description, FIG. 11 is an equivalent circuit diagram illustrating a circuit for driving one heater. The MOS transistor (MOSFET) 120 is controlled to drive the heater 102. The AND circuit 122 performs an AND operation on the signal input from the decoder 108 and the signal input from the logic circuit 123A and outputs the operation result to the level converter 121. The level converter (LVC) 121 receives the voltage VHTM and converts the output voltage from the AND circuit 122 into a driving voltage for the transistor 120. The heater 102 is supplied with the voltage VH. The AND circuit 122 is supplied with the voltage VDD. The MOS transistor 120 is connected to the ground (GND).

Figure 9:
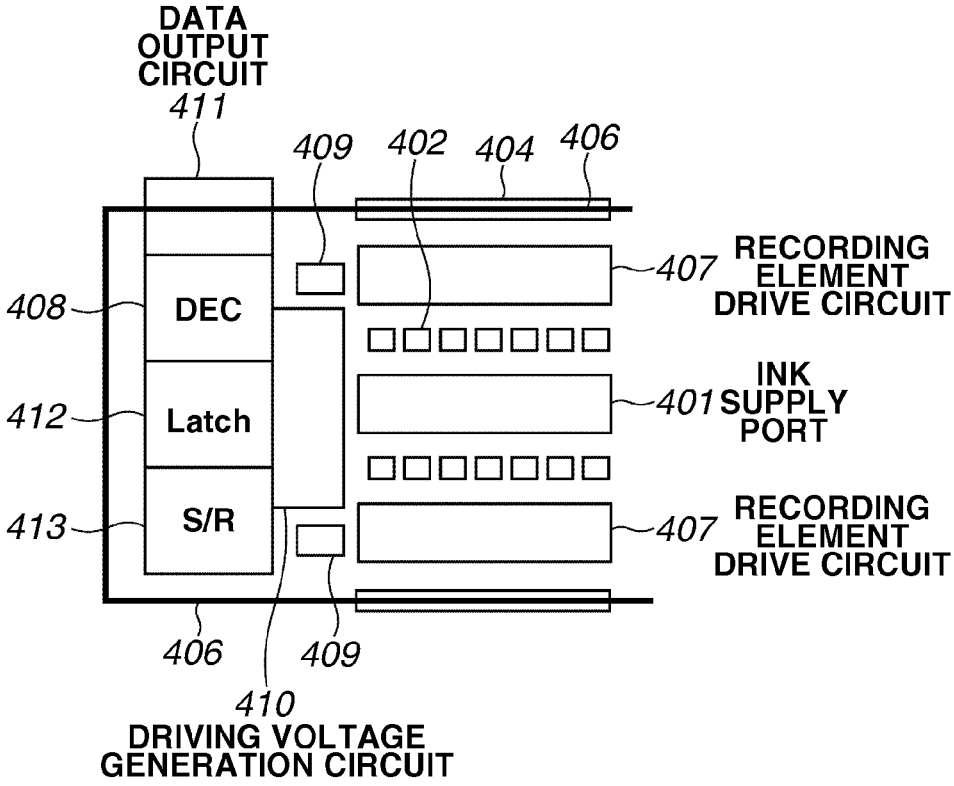
FIG. 9 is a diagram for comparison with the first exemplary embodiment.

Next, a case in which the first exemplary embodiment (FIGS. 1 and 2) is not implemented will be described with reference to FIG. 9. The drive circuit includes a recording element drive circuit 407, a data output circuit 411, a capacitive element (capacitor) 409, a driving voltage generation circuit 410, a decoder 408, a latch circuit 412, and a shift register 413. In the structure illustrated in FIG. 9, a description of the same components as those illustrated in FIG. 1 or FIG. 2 will not be repeated. In the structure illustrated in FIG. 9, the data output circuit 411 is arranged such that the heater (sub-heater) 406 overlaps with the data output circuit 411 without considering the influence of heat generated from the heater (sub-heater) 406. Therefore, the operation of the data output circuit 411 is affected by heat generated from the heater 406.

Figure 6B:
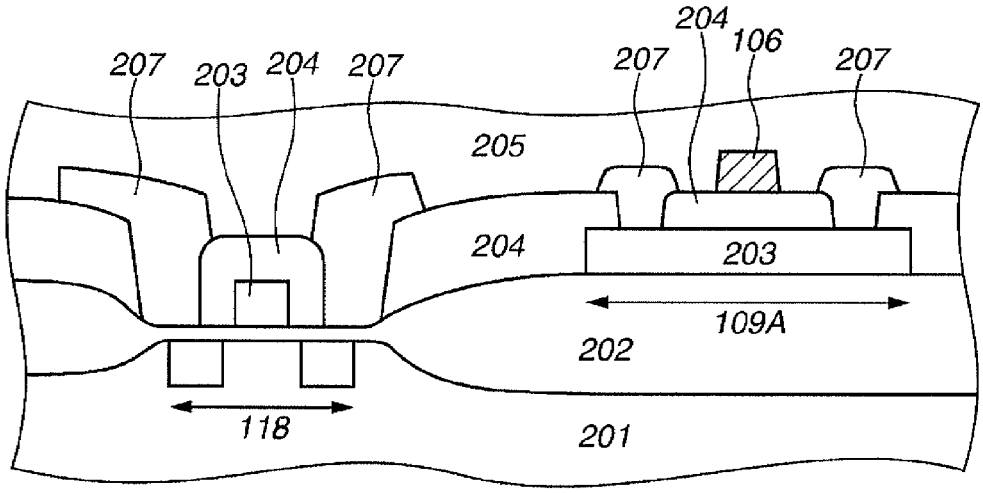

On the other hand, as in the first exemplary embodiment (FIGS. 1 and 2), the capacitive element 109 is arranged such that the heater 106 overlaps the capacitive element 109. This is because the capacitive element (capacitor) 109 is less affected by heat than the MOS transistor, as described above. A resistive element 109A may be provided instead of the capacitive element 109. Therefore, as illustrated in FIG. 6B, the resistive element 109A may be arranged to overlap the heater 106. For example, a POL resistor provided on a polysilicon layer is used as the resistive element 109A.

Figure 3:
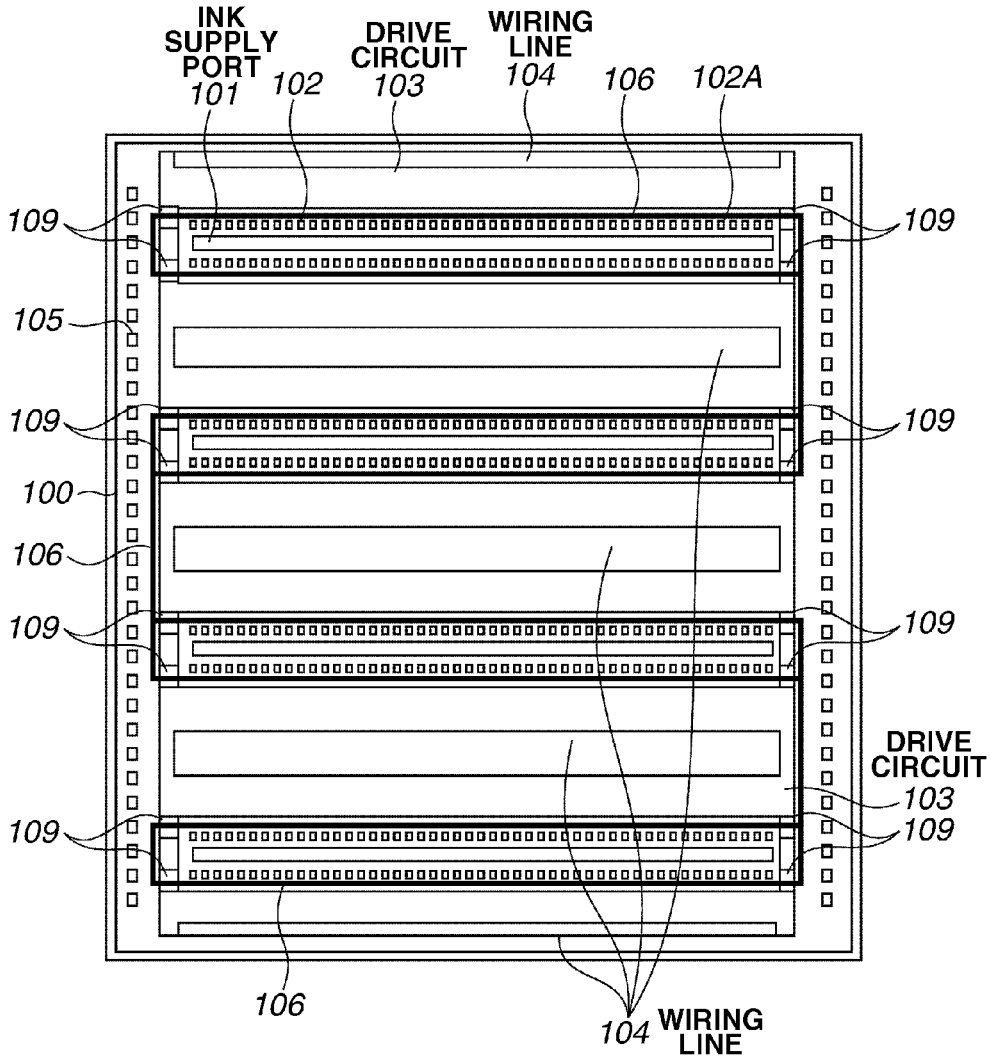
FIG. 3 is a diagram illustrating the arrangement of circuits of a recording element substrate according to a second exemplary embodiment of the invention.

FIG. 3 is a block diagram illustrating the circuit layout of a recording element substrate 100 according to a second exemplary embodiment of the invention. A description of the same components as those illustrated in FIG. 1 will not be repeated, and only components different from those illustrated in FIG. 1 will be described.

The capacitive element 109 is provided between the heater array 102A and the terminal 105. The heater (sub-heater) 106 is provided between the heater array 102A and the drive circuit 103. Similar to the first exemplary embodiment, in the second exemplary embodiment, the heater 106 (sub-heater) is provided above the capacitive element 109.

Figure 4:
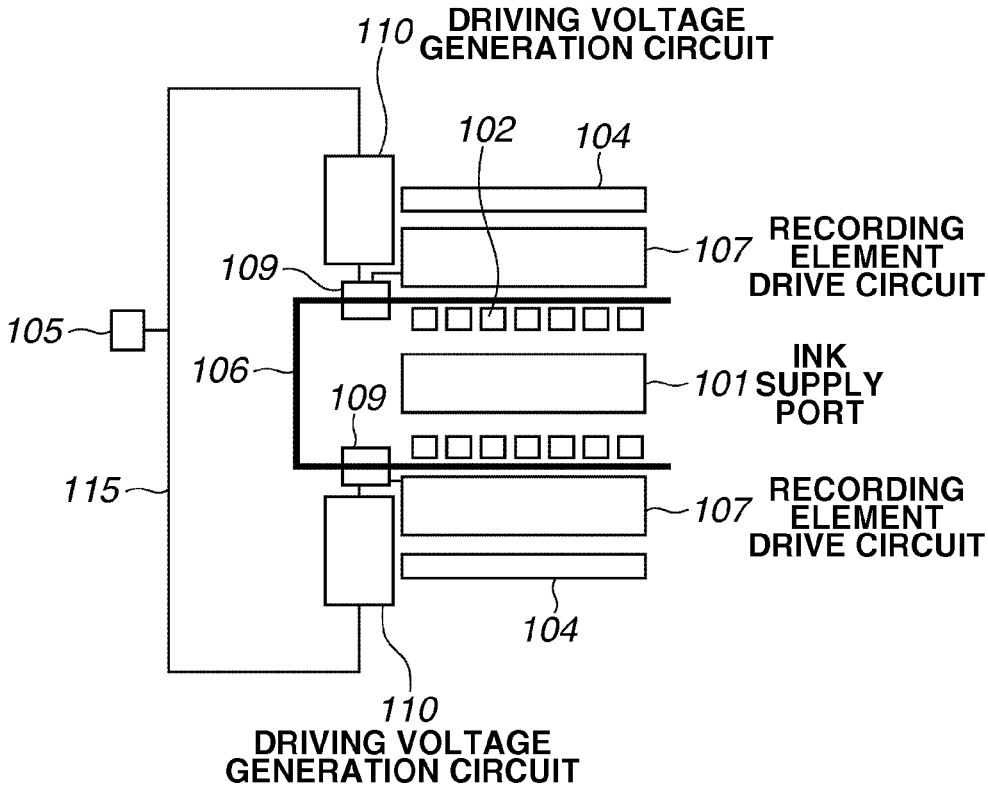
FIG. 4 is an enlarged view illustrating a portion of the circuit illustrated in FIG. 3.

FIG. 4 is an enlarged view illustrating a portion of the drive circuit 103 illustrated in FIG. 3. A description of the same components as those in the first exemplary embodiment will not be repeated. For simplicity of description, other signal lines are not illustrated. A voltage VHT is input to the terminal 105 and is then supplied to the recording element drive circuit 107 through a power line 115. The capacitive element 109 is connected to the power line 115.

Figure 5:
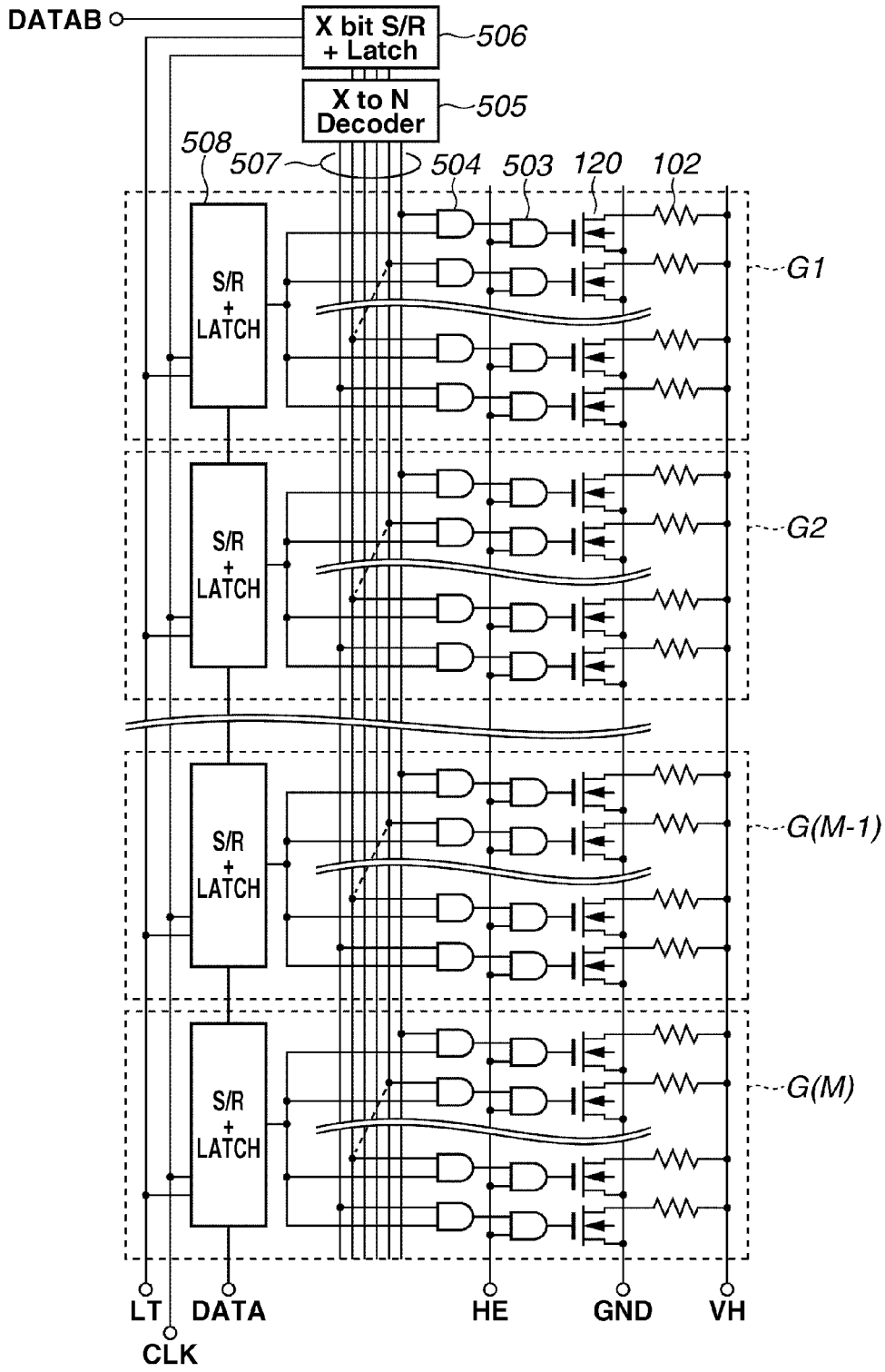
FIG. 5 is a block diagram illustrating the recording element substrate according to the second exemplary embodiment.

FIG. 5 is a diagram illustrating the recording element drive circuit 107 illustrated in FIG. 4. The recording element drive circuit 107 includes, for example, a shift register/latch 506, a decoder 505, a shift register/latch 508, a transistor 120, and logic elements 503 and 504. For simplicity of description, the driving voltage generation circuit 110 is not illustrated.

A recording head divides a plurality of heaters into a plurality of (M) groups and time-divisionally drives the groups of heaters. Each group includes N heaters 102. One heater selected from each group is driven at one driving timing. Then, the heaters to be driven are switched at each driving timing.

The shift register 506 stores data (DATAB) for selecting the heaters in each group. The decoder 505 decodes the data stored in the shift register 506 and outputs the decoded signal to a signal line 507. The shift register 508 stores 1-bit data allocated to each of the groups (G1, G2, . . . , GM). The shift register/latch 508 is arranged in the direction in which the heaters 102 are arranged. The decoder 505 outputs a signal for selecting one of N heaters. The decoder 505 selects the heater 102 to be driven and the transistor 120 is driven according to the value of the data stored in the shift register/latch 508.

Similar to the first exemplary embodiment, as an element that is relatively less affected by heat, instead of the capacitive element 109, the resistive element 109A may be provided below the heater 106.

Figure 7:
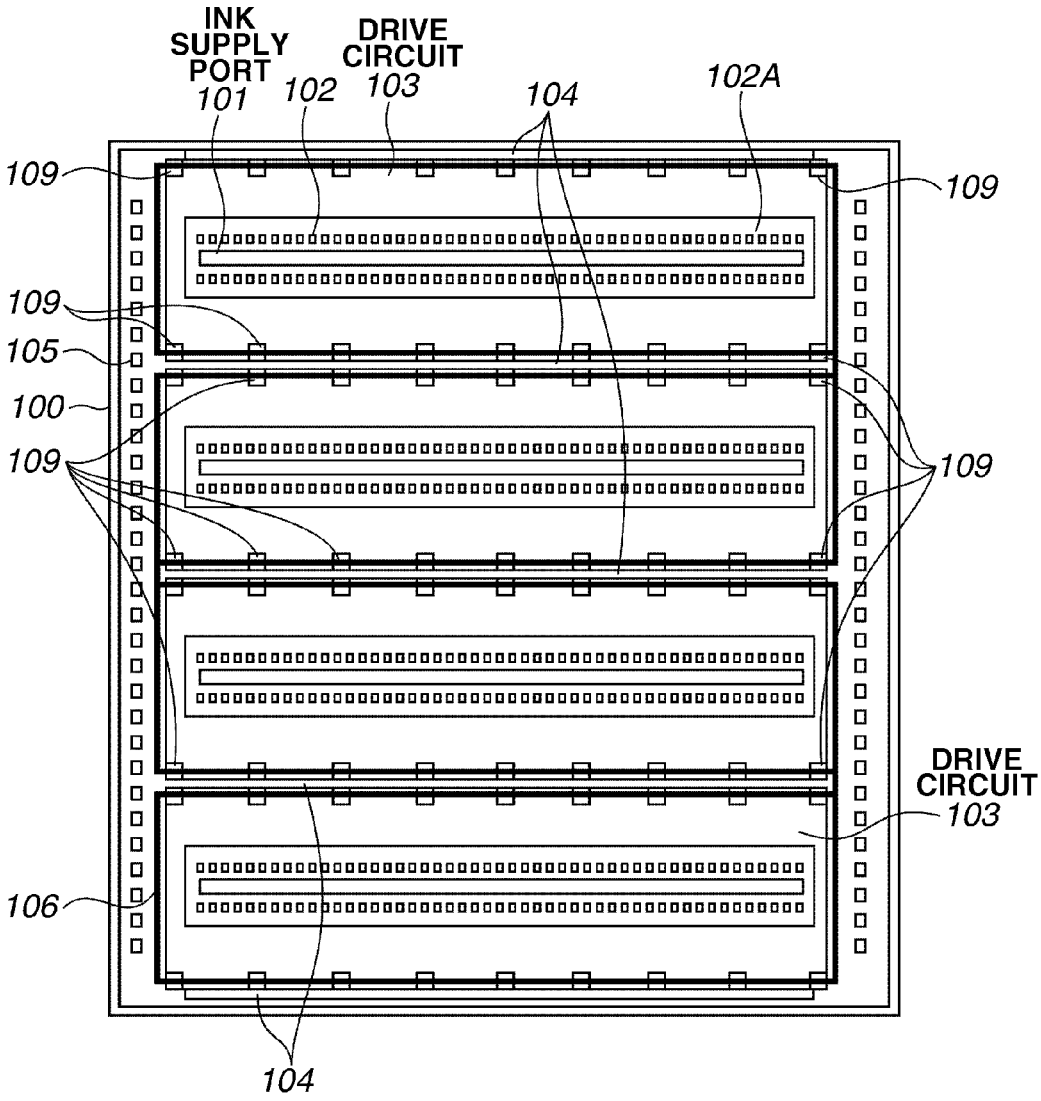
FIG. 7 is a diagram illustrating the arrangement of circuits of a recording element substrate according to a third exemplary embodiment of the invention.
Figure 8:
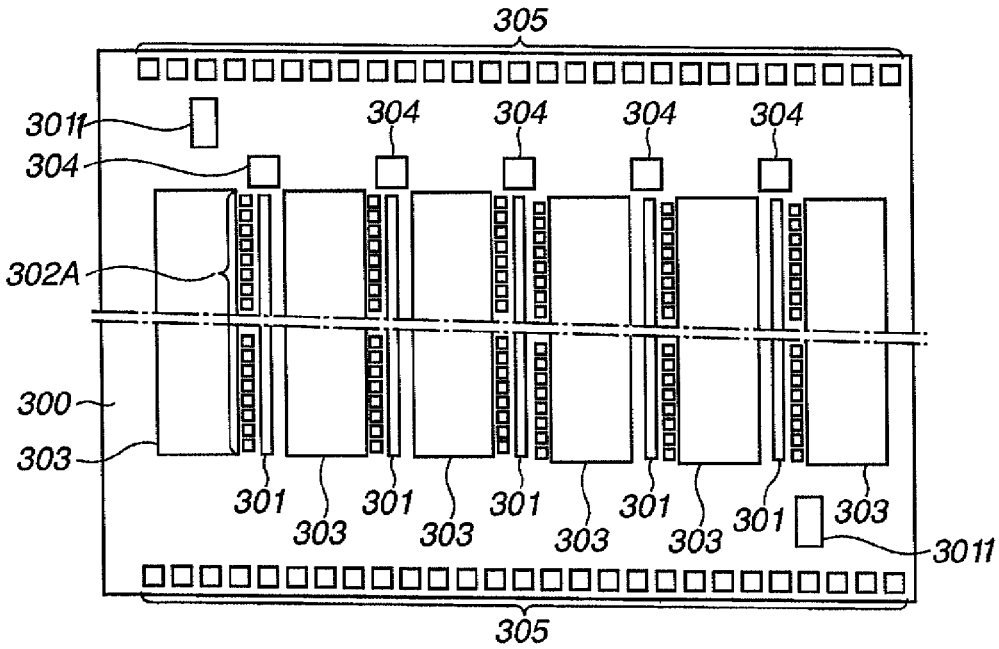
FIG.8 (PRIOR ART)
FIG. 8 is a layout diagram illustrating a circuit of a conventional recording element substrate.

FIG. 7 is a block diagram illustrating the circuit layout of a recording element substrate 100 according to a third exemplary embodiment of the invention. Components denoted by reference numerals 100 to 109 are similar to those illustrated in FIG. 1 or FIG. 3. The capacitive element 109 maybe arranged in the direction in which the heaters 102 are arranged.

The heater (sub-heater) 106 is provided to surround the ink supply port 101 on the surface of the substrate in a plan view of FIGS. 1 and 3. An endless heater 106 may be used or a portion of the heater 106 may be cut.

The circuit element that is arranged to overlap the heater 106 is not limited to the capacitive element 109 or the resistive element 109A as long as it is relatively less affected by heat.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-296697 filed Nov. 20, 2008, which is hereby incorporated by reference herein in its entirety.

What is claimed is:

1. A recording element substrate comprising:

a recording element array including a plurality of recording elements, the recording element generating heat energy when energized;

a drive circuit configured to drive the recording elements and having a plurality of MOS transistors, the MOS transistor configured to determine whether to energize the recording element;

a capacitive element located to be connected between the drive circuit and a terminal for supplying a voltage to operate the drive circuit; and a heater located to surround the recording element array, wherein the heater is not located above or below the MOS transistors in a perpendicular direction of a surface of the recording element substrate, and wherein the heater is located above the capacitive element in the perpendicular direction of the surface of the recording element substrate.

2. The recording element substrate according to claim 1, wherein the capacitive element is connected to a power line for supplying power to the drive circuit.

3. The recording element substrate according to claim 1, wherein the drive circuit includes at least a shift register, a latch circuit, and a decoder.

4. The recording element substrate according to claim 1, wherein the drive circuit includes a recording element drive circuit configured to drive the recording elements, and a voltage generation circuit configured to generate a voltage to be supplied to the recording element drive circuit, and wherein the capacitive element is connected to a power line connected between the voltage generation circuit and the recording element drive circuit.

5. The recording element substrate according to claim 1, wherein the heater is located to surround the drive circuit.

6. A recording head comprising the recording element substrate according to claim 1.

* * * * *